United States Patent [19]

Hepler

[11] Patent Number: 4,653,246

[45] Date of Patent: Mar. 31, 1987

[54] INSULATION BOARD FOR ATTACHMENT TO WALLS

[76] Inventor: Jacque P. Hepler, R.D. 2, Box 87, Hegins, Pa. 17938

[21] Appl. No.: 692,042

[22] Filed: Jan. 16, 1985

Related U.S. Application Data

[63] Continuation-in-part of Ser. No. 568,349, Jan. 5, 1984, abandoned.

[51] Int. Cl.[4] ..... E04B 5/00

[52] U.S. Cl. ..... 52/787; 52/309.2; 52/309.8; 16/2

[58] Field of Search ..... 52/309.2–309.5, 52/309.8, 309.11, 410, 411, 787, 309.16, 309.17; 16/2, 108, 109, 382; 404/40

[56] References Cited

U.S. PATENT DOCUMENTS

| | | | |
|---|---|---|---|
| 721,962 | 3/1903 | Maring | 52/606 |
| 1,129,637 | 2/1915 | Cameron | 52/98 |
| 1,448,886 | 3/1923 | Walper | 52/344 |
| 1,461,590 | 7/1923 | Walper | 52/344 |
| 1,467,127 | 9/1923 | Walper | 52/367 |
| 1,484,273 | 3/1923 | Peelle | 52/787 |
| 1,649,842 | 11/1927 | McBride | 52/302 |
| 1,657,193 | 1/1928 | Beshers | 52/506 |
| 1,682,726 | 8/1928 | Harloff | 52/600 |
| 1,702,776 | 2/1929 | Hazen | 52/612 |
| 1,778,927 | 10/1930 | Wright | 404/41 |
| 2,035,902 | 3/1936 | MacLeod | 52/410 |
| 2,181,103 | 11/1939 | Davis | 16/2 |
| 2,392,232 | 1/1946 | Crafton | 52/344 |
| 2,553,626 | 5/1951 | Barlow | 16/109 |
| 2,654,685 | 10/1953 | Voelker | 52/309.2 |
| 2,692,496 | 10/1954 | Thomas | 52/597 |
| 2,793,245 | 5/1957 | Dunn | 174/35 MS |
| 2,828,080 | 3/1958 | Rennels | 238/8 |
| 2,957,196 | 10/1960 | Kreider et al. | 16/2 |
| 3,008,552 | 11/1961 | Cushman et al. | 52/787 |
| 3,039,232 | 6/1962 | Dunn | 52/309.8 |
| 3,170,270 | 2/1965 | Sparber et al. | 52/357 |
| 3,362,119 | 1/1968 | Murphy | 52/309.8 |
| 3,499,256 | 3/1970 | Schaaf et al. | 52/483 |
| 3,619,437 | 11/1971 | McDonald, Jr. | 52/309.8 |
| 3,930,347 | 1/1976 | Megumi | 52/221 |
| 3,977,146 | 8/1976 | Wiley | 52/787 |
| 4,063,395 | 12/1977 | Stewart et al. | 52/309.5 |
| 4,226,676 | 10/1980 | Barnes | 52/410 |
| 4,232,496 | 11/1980 | Warkentin | 52/309.2 |
| 4,334,394 | 6/1982 | Näder | 52/309.12 |
| 4,359,849 | 11/1982 | Goeman | 52/479 |
| 4,394,201 | 7/1983 | Haeussler | 52/410 |
| 4,500,255 | 2/1985 | Wess | 52/309.2 |
| 4,577,450 | 3/1986 | Large | 52/787 |

FOREIGN PATENT DOCUMENTS

| | | | |
|---|---|---|---|
| 500650 | 3/1954 | Canada | 16/382 |
| 2643530 | 4/1978 | Fed. Rep. of Germany | 52/309.8 |
| 2813098 | 10/1979 | Fed. Rep. of Germany | 52/787 |
| 33533 | 5/1964 | Finland | 16/382 |
| 602968 | 8/1978 | Switzerland | 52/309.8 |
| 545628 | 6/1942 | United Kingdom | 52/309.16 |

OTHER PUBLICATIONS

STO Industries Inc., "STO-Sheathing Dowel", Apr. 10, 1983, 2 pages (front and back).

*Primary Examiner*—John E. Murtagh
*Assistant Examiner*—Andrew Joseph Rudy
*Attorney, Agent, or Firm*—Robert B. Frailey

[57] ABSTRACT

Insulation board for attachment mechanically to the exterior or interior walls of buildings and the like. The insulation board is composed of at least one panel of insulation material provided with a plurality of spaced, transversely extending holes for reception of fasteners for attaching the board to a building wall. Disposed coaxially within each hole is a flanged sleeve through which fasteners, such as screws, nails, welding studs or the like are inserted for securing the board in tight abutting relation to the surface of the wall. The fasteners are provided with heads which engage the flanged ends of the hollow sleeves, and have their opposite ends protruding from one surface of the insulation board for penetration into, and securement to, the wall.

17 Claims, 11 Drawing Figures

INSULATION BOARD FOR ATTACHMENT TO WALLS

RELATED APPLICATION

This application is a continuation-in-part of my pending U.S. patent application Ser. No. 568,349 now abandoned filed Jan. 5, 1984 entitled "Insulation Board for Attachment to Walls" now abandoned.

FIELD OF THE INVENTION

This invention pertains to heat insulating wallboard, and particularly pertains to insulation board for attachment to the exterior or interior walls of buildings and the like.

Increasingly, in the construction of new buildings and in the renovation of older buildings, it has become more common to cover the exterior surfaces of walls with a layer of insulation board to reduce energy losses. The insulating layer is constituted of a plurality of uniform, relatively rigid, rectangular panels composed of a suitable insulating material, such as expanded polystyrene plastic insulation. The panels usually are available in standard sizes, on the order of 2'×8'×1", or 2" or more in thickness.

The flat, rectangular insulation boards or panels are cemented to the surface of the wall in abutting relation to each other, to provide a continuous or uninterrupted layer of insulation. After the insulating panels have been cemented to the wall, their exterior surfaces are finished by the application of suitable materials to provide an aesthetic, tough and wearable surface which will withstand all types of weather and climate exposures. It is the practice, following the installation of insulation boards or panels to a wall surface, to finish the exterior surface of the insulating layer by the successive application thereto of a layer of reinforcing fabric, a base coating composed of a plaster and cement mixture and a finish coat composed of a suitable plaster to provide an attractive weathering surface.

However, because of many disadvantages inherent in the cementing of such insulating wallboard layers to wall surfaces, the range of use of such insulation panels or boards has been limited. The cement does not adhere to painted, wood nor metal surfaces. Although the cemented insulation board adheres well to bare masonary and to exterior sheetrock surfaces, painted masonary surfaces first must be sand blasted before application. Additionally, to ensure an effective, long lasting cement bond for adhering the panels to a wall surface, the temperature of the ambient atmosphere should be within the range of 40° to 80° F. at the time of the application of the cement, and from 8 to 12 hours drying time should be permitted.

Thus, although the utilizing of rectangular panels of insulation wallboard to provide an insulating layer for building walls offers significant advantages to both the construction of new buildings and the renovating of old buildings, such wall systems have received only limited application in the building industry. The present invention overcomes the foregoing shortcomings, and provides means whereby insulation boards of the type described may be utilized successfully, efficiently and as inexpensively with a wide variety of wall constructions.

SUMMARY OF THE INVENTION

The primary object of this invention is to provide a new and improved mechanical fastening system for attaching rigid insulation board to the exterior or interior surfaces of the walls of buildings and the like.

A further object is to provide a new composite insulation board or panel having an improved wall attachment means, whereby the insulation boards or panels may be quickly, efficiently, inexpensively, mechanically and permanently attached to the exterior or interior surfaces of a wall irrespective of the material from which the wall is constructed or the temperature of the ambient atmosphere.

A further object is to provide a new insulation board for attachment to the walls of buildings and the like, irrespective of the composition of the wall, constituted of at least one panel of insulation material having a plurality of spaced, transversely extending holes, the board including mechanical fastening means for securing the board to a wall comprising a plurality of hollow sleeves disposed internally of the board, and fastening devices located within each sleeve and having wall penetrating ends protruding from the board for affixing the board to the wall.

Other objects and advantages of this invention will be readily apparent from the accompanying detailed description of the preferred embodiments thereof, which are illustrated in the views of the accompanying drawing.

DESCRIPTION OF THE INVENTION

Figure 1:
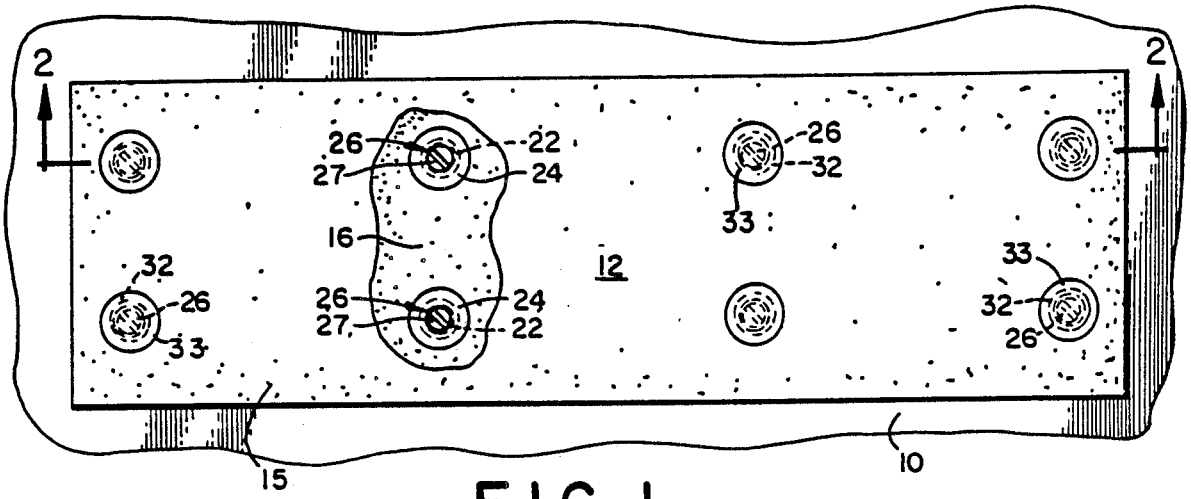
FIG. 1 is a view in front elevation of a preferred insulation board of this invention, attached to a vertical wall and having a portion of its exterior area broken away for purpose of illustration.
Figure 2:
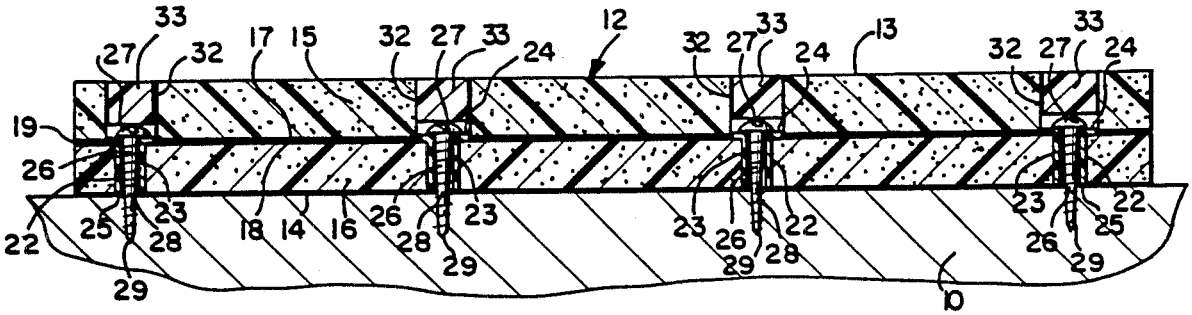
FIG. 2 is a sectional view looking in the direction of the angled arrows 2—2 of FIG. 1.

Referring first to FIGS. 1 and 2 of the drawing, there is illustrated a portion of a vertical building wall 10 to which is attached a rigid rectangular insulation board 12 embodying this invention. The insulation board 12 is provided with a flat outer surface 13 and a flat inner surface 14 which is contiguous or flush with the flat surface of the wall 10. The board 12 may be composed of two abutting, congruent insulation panel components or layers 15, 16. The interior, opposing surfaces 17, 18 of the two panel components 15, 16 are contiguous, and preferably are bonded together by a suitable adhesive or cement indicated generally by the reference numeral 19 in FIG. 2.

The superimposed panel components 15, 16 which constitute the insulation board or panel 12 are slightly compressible and preferably are composed of an aerated, lightweight, multicellular polystyrene plastic, frequently referred to as "expanded polystyrene insulation", and sold, for example, under the trademark "STYROFOAM". The adhesive 19 for securely laminating the two components 15, 16 of the insulation panel 12 together preferably may constitute a polyvinyl acetate emulsion or a polyvinyl chloride emulsion.

Figure 5:
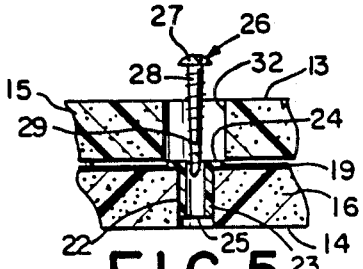
FIG. 5 is a fragmentary, exploded view in vertical section illustrating preferred panel attachment components for securing the insulation board of the invention to the surface of a wall.

The inner panel component 16 is provided with a plurality of spaced holes 22 in each of which is snugly engaged a hollow or tubular sleeve 23. The inner end of each sleeve 23 is provided with a flange 24 which engages with, and rests against, the interior surface 18 of panel 16, thereby preventing sleeves 23 from accidentally slipping out of their respective holes 22. As illustrated in FIG. 5, the axial length of the tubular portion of the sleeve 23 is slightly less than the normal thickness of the insulation panel component 16, whereby the outer end 25 of the sleeve 23 terminates within the hole 22 at a location a short distance inwardly from the inner surface 14 of the insulation board 12. By way of example, where insulation panel components 15, 16 having a thickness of 1" are utilized, the inner end 25 of the sleeve may terminate internally of its hole 22 at a location on the order of ¼" or less from the inner panel surface 14.

Disposed internally of each hollow sleeve 22 is a suitable fastener 26 having an enlarged head portion 27 from which extends a tapered, threaded stem or shank 28. The diameter or cross-sectional area of the fastener heads 27 is greater than the diameter or cross-sectional area of the hollows of the tubular sleeves 23, and the length of the fastener stems 28 is greater than the thickness of the insulation panel component 16. Thus, when the fasteners 26 are fully inserted internally of their respective hollow sleeves 23, as illustrated in FIG. 2, the lower surfaces of their heads 27 bear against the opposing upper surfaces of the sleeve flanges 24, and the distal ends 29 of their stems or shanks 28 protrude outwardly from the inner surface 14 of the composite insulation board 12. The protruding distal ends 29 of the threaded fastener stems 28 penetrate into the wall 10, and function to rigidly secure the insulation board or panel 12 to the wall 10.

The outer insulation panel component 15 also is provided with a plurality of spaced holes 32, each of which is coaxial with one of the spaced holes 22 formed in the inner panel 16. Preferably, as illustrated in FIG. 2, the diameters of the holes 32 in the outer panel 15 are substantially equal to, or slightly larger than, the diameters of the flanges 24 of the hollow sleeves 23. Thus, when the two insulation panels 15, 16 are laminated together, the sleeve flanges 24 are engaged within the inner or lower portions of the holes 32 in the outer panel 15.

It is preferred that the holes 32 in the insulation panel 15 be of a larger diameter or cross-sectional area than their corresponding, coaxial holes 22 in the insulation panel 16. However, it is within the scope of this invention, and would be in the interest of uniformity of mass production, to provide outer insulation panels 15 with holes 32 having diameters or cross-sectional areas equal to those of the holes 22 in the inner insulation panels 16. Although in such an arrangement the flanges 24 of the tubular sleeves 23 cannot engage within the holes 32 of the panel 15 when the composite insulation board 12 is assembled, the inherent flexibility of its panel components 15, 16 permits the opposing interior surfaces 17, 18 of the two components to be pressed into abutting or contiguous relationship and laminated securely together by the adhesive or cement 19.

To complete the construction of the composite insulation board 12, plugs 33 are inserted into the holes 32 in the outer insulation panel 15. The plugs 33 preferably are composed of the same insulation material as the two panels 15, 16, and are retained snugly within holes 32. The inner ends of the plugs 33 bear against the heads 27 of the fasteners 26, and their outer ends are flush, or co-planar, with the flat outer surface 13 of the insulation panel or board 12.

The insulation panel components 15, 16 may be of standard 2'×8' size, and preferably are each at least 1" thick. The hollow sleeves 23 preferably are made of a suitable metal, such as aluminum, or plastic, such as polypropylene, and may be extruded or molded so that their flanges 24 are integral with their tubular portions. In assembling the composite insulation board 12, the several sleeves 23 first are inserted into the holes 22 in the inner panel component 16. Thereupon, one or both of the opposing interior surfaces 17, 18 of the panel components 15, 16 are coated with the adhesive 19, following which the outer panel component 15 is superimposed upon the inner panel component 16, with their respective holes 22, 32 aligned axially as shown in FIG. 5. The two panel components 15, 16 are pressed together and securely laminated by the adhesive 19.

After the composite insulation board or panel 12 is thus assembled, it is placed at a selected location on the surface of the wall 10, whereupon the fasteners 26 are inserted through the holes 32 into the interiors or hollows of the sleeves 23 for attachment to the wall 10. The wall penetrating or distal ends 29 of the threaded stems 28 of the fasteners 26 are suitably driven, screwed or otherwise inserted into the wall 10 to rigidly and securely attach the insulation board 12 to the wall, in the manner shown in FIG. 2.

The character of the mechanical fasteners 26 utilized depends on the material from which the wall 10 is constructed. Where the wall 10 is composed of aluminum sheet siding, the fasteners 26 preferably are pan head sheet metal screws. Such screws are turned to penetrate the wall 10 sufficiently so as to compress slightly the inner insulation panel component 16, whereby the outer ends 25 of the hollow sleeves 23 are disposed proximate to the surface of the wall 10, as illustrated in FIG. 2. Thus, the fasteners 26 tightly secure the inner surface 14 of the board 12 to the surface of the wall 10.

In the event the wall 10 is constituted of light gauge steel, 22ga or less, similar sheet metal screws may be utilized as the fasteners 26. When fastening the board 12 to a wall 10 of heavy steel construction, stud welding pins, installed by means of a stud welding gun, may be utilized as the fasteners 26. In a situation where welding studs are not desirable or practical, self drilling fasteners may be utilized for the fasteners 26.

In fastening insulation boards 12 to a masonary wall 10, such as brick, concrete, cement block or the like, it is preferred that holes first be drilled in the wall by a suitable masonary bit. Thereafter, fasteners 26 in the form of screw type anchors, which cut threads into the masonary, are utilized.

For fastening the panels or boards 12 to a wall 10 composed of wood, the fasteners 26 preferably comprise round head wood screws on the order of 2" in length.

Not only is the insulation board of this invention adaptable to, and usable with, building walls composed of a wide range of materials, but the invention dispenses with any necessity for sand blasting masonary or other walls, or otherwise treating previously painted walls, preparatory to attaching insulation boards or panels thereto. Thus, this invention greatly expands the range of use of rectangular insulation boards for insulating the walls of buildings and the like while significantly reducing expenditures of time and expense heretofor involved in providing such insulated wall construction.

After the board 12 has been firmly secured to the wall 10 by the fasteners 26, the insulating plugs 33 are inserted into the holes 32 to complete the installation. Thereupon, the usual finishing steps may be carried out which are characteristic of present day insulated wall system construction, e.g. the application to the outer surface 13 of the board 12 of a reinforcing fabric, a base coating composed of a plaster and cement mixture and a finish coat composed of a suitable plaster to provide an aesthetic weathering surface for the insulation board 12.

Although the insulation board 12, in its form described above, is constituted of two separate, superimposed insulation panels 15 and 16, it is within the scope of this invention to provide a board 12 composed of a single, unitary insulation panel of uniform thickness, with the hollow sleeves 23 embedded internally thereof. In such a construction, the unitary insulation board 12 may be molded into a rigid, integral rectangular panel in a mold in which the sleeves 23 first have been suitably suspended. The expanded polystyrene plastic material is introduced into the mold in the form of beads. The molding operation is carried out under suitable conditions of pressure and temperature to form the plastic beads into a single, integral panel 12 with the sleeves 23 embedded internally thereof.

Manifestly, if desired, the board 12 also may be constituted of more than two superimposed insulation panel components. Also, if desired, the flanges 24 of the sleeves 23 may take the form of separate washers.

Figure 3:
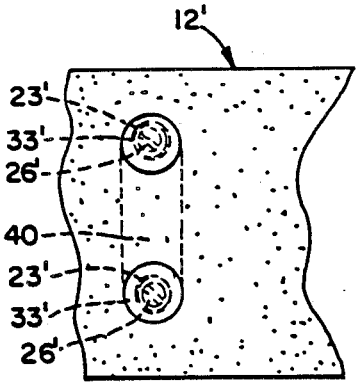
FIG. 3 is a fragmentary view in front elevation showing a modification of the invention.

In the modification illustrated in FIG. 3, there is shown a portion of an insulation board 12' having fasteners 26' and plugs 33' in which pairs of spaced hollow sleeves 23' are connected integrally by means of rectilinear straps 40.

Figure 4:
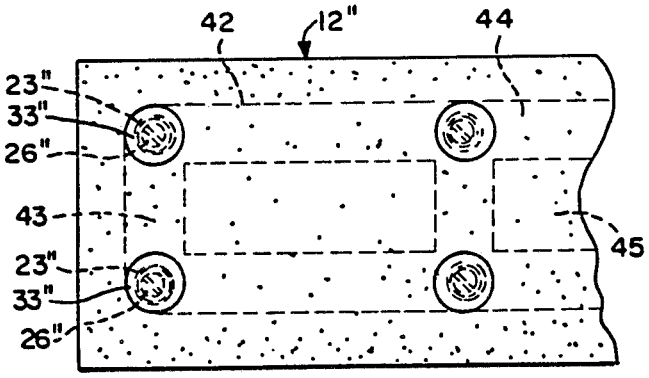
FIG. 4 is a fragmentary view in front elevation showing a second modification of the invention.

FIG. 4 illustrates a further modification in which all of the hollow sleeves 23" are connected integrally by means of a rectangular grid 42. The grid 42 is constituted of spaced transverse straps 43 and spaced, longitudinally extending straps or links 44. The grid 42 and its accompanying sleeves 23" preferably constitute a unitary molded plastic construction composed, for example, of high impact polypropylene. It may be formed with open areas 45 defined by the rectilinear, intersecting straps 43, 44.

The strap 40 and grid 42 illustrated in the modifications of FIGS. 3 and 4 may be on the order of 1/16" in thickness, and preferably are joined integrally to, and merge with the flanges of their respective tubular sleeves. They may, of course, be composed of metal as well as of plastic. Straps 40 and grids 42, as illustrated in FIGS. 3 and 4, provide an enhanced rigidity or stability to the insulation panels 12 of this invention.

Referring next to FIGS. 6–9, there are illustrated two additional modifications of this invention in each of which the rigid rectangular insulation board is composed of a single panel 50 of uniform thickness having a plurality of spaced, relatively small holes 51 formed in its inner portion and a plurality of spaced, relatively large holes 52 formed in its outer portion, each of the smaller holes 51 being coaxial with, and in open communication with, one of the larger holes 52. Snugly inserted individually into each of the smaller holes 51 is a hollow or tubular sleeve 53 having a flange 54 formed at its inner end. The hollow flanged sleeves 53 preferably are identical in construction to the hollow sleeves 23 previously described. They may be of plastic, such as molded polypropylene, whereby their flanges 54 are integral with their tubular portions, the outer ends 55 of which terminate within the small holes 51 at locations a short distance inwardly from the inner surface 56 of the insulation board 50.

In the interest of clarity of explanation, the fasteners 26 for securing the panels 50 to a wall have been omitted from FIGS. 6–9, as have the plugs, similar to plugs 33, for closing the larger holes 52. In the single panel embodiment of the invention illustrated in FIGS. 6–9, the aligned holes 51, 52 preferably are formed in the panel 50 by drilling, utilizing a drilling tool having a double cutting bit or blade designed for drilling a single, composite, two diameter hole of the relative size and form of the coaxial holes or hole portions 51, 52.

Figure 6:
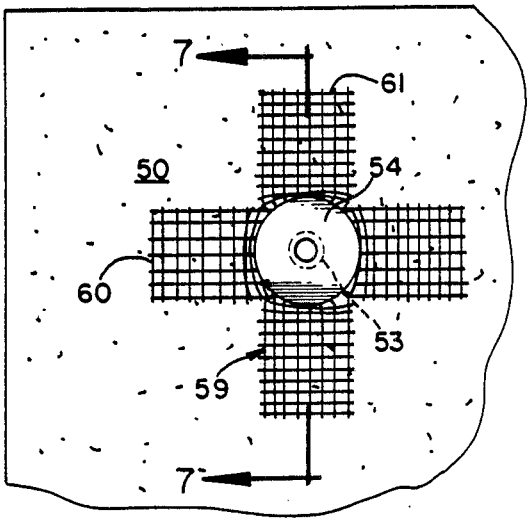
FIG. 6 is a fragmentary view in front elevation showing a third modification of the invention.
Figure 7:
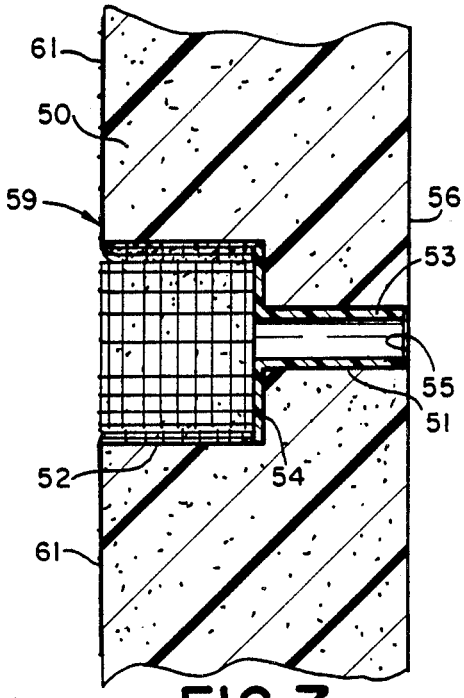
FIG. 7 is a fragmentary view in section looking in the direction angled arrows 7—7 of FIG. 6.

In the modification of FIGS. 6 and 7, a flexible, mesh-like reinforcing material 59 in the form of a cross is utilized to increase the holding strength of the mechanical fastening system of this invention. The mesh material or web 59 is constituted of two members 60, 61 which intersect each other at right angles and, preferably, are of the same length. The two intersecting members 60, 61 may be integrally joined together to form the cross-like reinforcement 59, or they may be composed of two separate, superimposed, tape-like components. The intersecting members 60, 61 forming the cross-shaped material 59 preferably are composed of an open-weave fiberglass fabric of the type used as a reinforcing fabric in the conventional finishing of the exterior surfaces of insulation panels applied to the walls of buildings and similar structures.

In assembling the insulation board or panel 50 of FIGS. 6–7 for securement to the surface of a wall, the cross-shaped reinforcement fabric 59 first is placed over the outer end of the larger hole 52 so that its center is coaxial with the two aligned empty holes 51, 52. With the fabric reinforcement 59 thus covering the hole 52, a hollow sleeve 53 is inserted into the aligned holes, in the manner illustrated in FIG. 7, to push the center portion of the cross-like fabric reinforcement 59 into the large hole 52. The insertion of the sleeve 53 causes its outer end 55 to rupture and pass through the central area of the fabric 59. As a result, when sleeve 53 is inserted completely into the smaller hole 51, its flange is pressed against the bottom of the larger hole 52, thereby snugly retaining or locking fabric 59 internally of hole 52.

It will be understood that, in the manner described above, a reinforcement fabric 59 is inserted into each of the several panel holes 52, and clamped in the bottom thereof by the flange 54 of one of the hollow sleeves 53, in the manner illustrated in FIGS. 6–7. Thereafter, to complete installation of the panel 50, fasteners 26 are inserted into the several axially aligned holes 52, 51 in the manner previously described, for securement of the panel to a wall. Then the plugs are inserted into the larger holes 52 and, finally, the usual finishing steps are carried out, i.e. the application of the reinforcing fabric and the base and finish coatings to provide a finished external surface for the insulation board 50. The application of the reinforcing fabric and the two coatings ensures that the outer or distal ends of the two intersecting members 60, 61 of the cross-shaped reinforcing material 59 are laid flush or flat on the outer surface of the panel 50.

The outwardly extending end portions of the intersecting members 60, 61 function as reinforcing elements to strengthen the mechanical fastening system which characterizes this invention. More particularly, the outwardly extending ends of the members 60, 61 of the reinforcing material 59 increase the bearing surface of the mechanical fastening system of this invention and thereby enhance its holding power. The embodiment illustrated in FIGS. 6 and 7 is particularly useful in the application of panels 50 of insulation material to the upper exterior walls of high buildings, where negative wind loads or factors are a problem. The negative wind factor always is a problem at higher building altitudes, and is prone to rip or pull off external wall paneling which is not adequately secured. The embodiment of this invention utilizing the cross-like reinforcing material 59 provides a strong, mechanical fastening arrangement for external insulation panels, and neutralizes the effect of the negative wind factor to ensure that the panels will remain firmly secured to the building.

Figure 8:
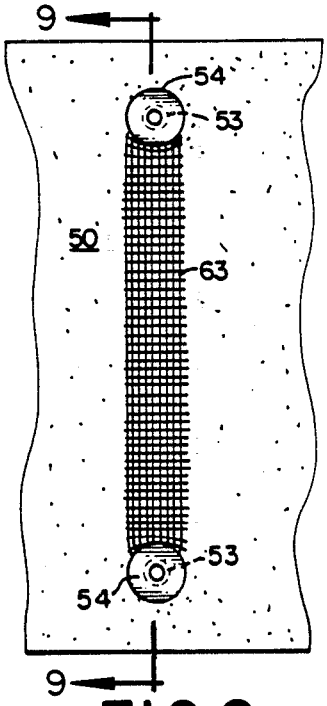
FIG. 8 is a fragmentary view in front elevation showing a fourth modification of the invention.
Figure 9:
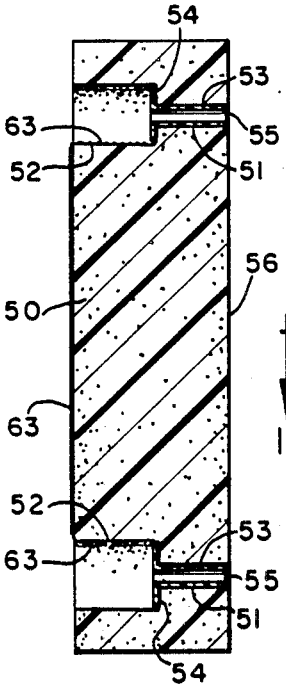
FIG. 9 is a sectional view looking in the direction of the angled arrows 9—9 of FIG. 8.

In the embodiment illustrated in FIGS. 8 and 9, the cross-shaped reinforcement 59 is replaced by an elongated, preferably vertical strip or tape 63 of reinforcing material of similar mesh structure and composition. The mesh reinforcing tape 63, which also may be composed of fiberglass fabric, spans the distance between two vertically spaced holes 52. Its opposite ends, as shown in FIG. 9, are securely clamped or retained in the bottoms of the two spaced holes 52 by means of the flanges 54 of the hollow sleeves 53. Thus, when the fasteners (not shown) and plugs (not shown) are properly installed internally of the panel 50 of FIGS. 8 and 9, the reinforcing tape or fabric 63 will function to provide an additional bearing surface for the fastening system of the invention, thereby enhancing the mechanical strength of its panel retention system.

In the embodiment of FIGS. 8–9, a strip of mesh fabric 63 will be clamped within, and extend between, each pair of vertically spaced holes 52. If desired, however, the tape-like fabric strips may be disposed horizontally between horizontally spaced holes. Of course, the length of the tape reinforcement 63 must be considerably longer than the spacing between the spaced holes 5Z which it connects, to ensure that its opposite ends extend fully into, and over the bottoms of the holes. This ensures proper clamping of the elongated reinforcement 63 by the flanges 54, after the panel 50 has been assembled and installed.

Figure 10:
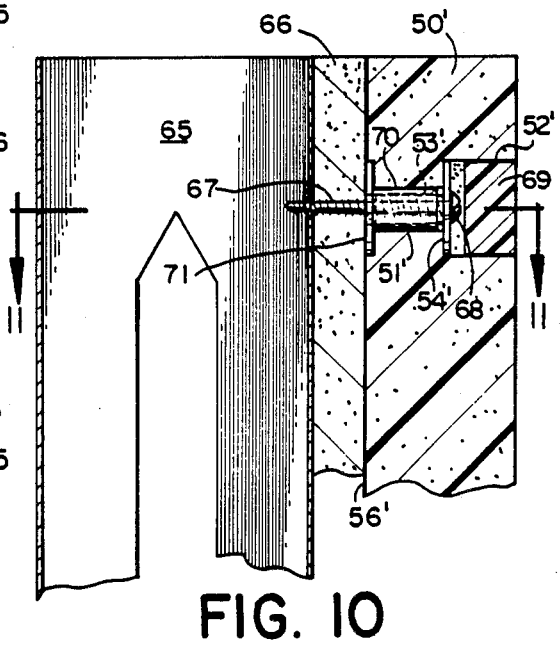
FIG. 10 is a fragmentary view in vertical, transverse section showing a fifth modification of the invention.
Figure 11:
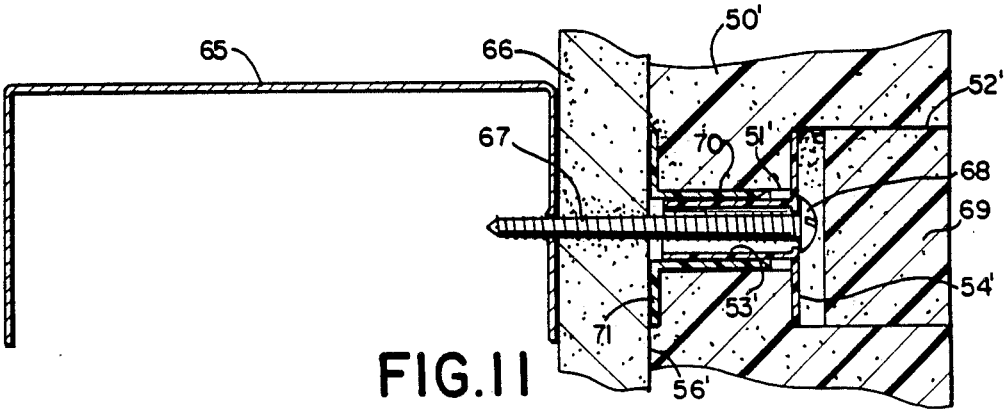
FIG. 11 is a fragmentary view in section looking in the direction of the angled arrows 11—11 of FIG. 10.

FIGS. 10–11 illustrate the application of this invention to an outer building wall where exterior sheetrock is utilized. In such structures, rectangular panels of sheetrock are affixed by suitable fastening means to vertical metal studs, usually of C-cross section. Because of the inherent tensile weakness of sheetrock paneling, such structures are prone to rupture, and to be torn or ripped from the metal studs to which they are attached, as a result of the negative wind loads or factors which are present at the upper stories of tall buildings.

Referring particularly to FIGS. 10 and 11, there are illustrated, by way of example, a vertical structural metal stud 65 of C-cross section, a vertical panel of sheetrock 66 and a vertical panel 50' of rigid insulation board. In accordance with this invention, the panel 50' is provided with a series of spaced, relatively small holes 51', a series of spaced, relatively large holes 52' and hollow sleeves 53' having flanges 54' formed at their inner ends. The arrargement illustrated in FIGS. 10 and 11 also includes a fastener 67, in the form of a sheet metal screw having an enlarged head portion 68, for mounting the panels 50', 66 in contiguous, vertical relation to each other and for securing the ensemble to the metal stud 65. As will be observed, the flat inner surface 56' of tbe insulation panel or board 50' is mounted in abutting relation to the flat outer surface of the sheetrock panel 66. Plugs 69, similar to plugs 33 previously described, are inserted into the enlarged holes 52' formed in the outer portion of the panel 50'.

To strengthen the attachment of the contiguous vertical panels 50', 66 to the metal studs 65, the embodiment of FIGS. 10 and 11 includes, in each small hole 51', a second hollow sleeve 70 provided with a flange 71 at its outer end. As shown, the two sleeves 53', 70 are aligned in reverse relation to each other with their flanges 54', 71 disposed in spaced, opposing relation to each other. The tubular portion of the hollow sleeve 70 is slightly larger diametrically than the tubular portion of the hollow sleeve 53', thereby permitting sleeve 70 to be engaged telescopically with, and externally of, sleeve 53'.

In order to accommodate the telescopic mating of the two hollow sleeves 53', 70, the bores of the holes 51' must be suitably enlarged. The dimensions of the diameters of the small holes 51' and of the tubular portions of the sleeves 53' and 70 are such as to provide a snug assembly of those three parts. It will be observed that, at each location of mechanical attachment, the holes 51', 52', hollow sleeves 53', 70, fastener 67 and plug 69 are axially aligned.

The flanges 54', 71 of the hollow sleeves 53', 70 may be of equal diameter. The sleeves 53', 70 preferably are molded of a suitable plastic material, such as polypropylene, with their flanges 54', 71 integral with their respective tubular portions. Of course, the telescopic disposition of hollow sleeves 53', 70 relative to each other, if necessary or desirable, could be reversed whereby sleeve 70 would be inserted internally of sleeve 53'.

The provision of the second hollow sleeve 70, disposed in snug, telescopic relationship with hollow sleeve 53', functions to increase the tensile strength of the mschanical fastening system of the invention illustrated in FIGS. 10 and 11. The flange 71 of the second hollow sleeve 70 provides an increased bearing area which reinforces the mechanical holding force of the invention. It provides greatly increased resistance to the forces of the negative wind factor which, in prior installations, were instrumental in causing the exterior sheetrock panels 66 to break away from the metal studs 65 to which they had been secured. Because of the inherent compressibility of the insulation panel 50', which preferably also is composed of aerated multicellular expanded polystyrene, flanges 71 of the hollow sleeves 70 are pressed or squeezed slightly into the panel when the assembly is installed, thereby permitting the flat inner surface 56' of the panel 50' to become cortiguous with the flat outer surface of the sheetrock panel 66.

As will be observed, this invention comprises insulation board having means for its mechanical attachment to a building wall, characterized by (a) at least one panel of insulation material having a plurality of transversely extending spaced holes, each hole having axially spaced openings, (b) a hollow sleeve disposed completely within each hole and extending coaxially thereto, (c) each sleeve having a flange at one end located intermediate the axially spaced openings of the hole, and (d) a fastener located within each sleve and having a wall penetrating end protruding from the panel and a head disposed in abutting relation with the flange, (e) the head being located intermediate the axially spaced openings of the hole.

Although several preferred embodiments of this invention have been shown and described herein for the purpose of illustration, it is to be understood that such embodiments are exemplary only of the utility of this invention, and that various changes, modifications and alterations may be made thereto without departing from the spirit and utility of the invention, or from the scope thereof as set forth in the claims.

I claim:

1. Insulation board for attachment to the walls of buildings and the like comprising a panel of insulation material having an outer surface and an inner surface to be disposed against a wall, a plurality of spaced holes extending transversely through the panel, each said hole having a relatively small inner portion and an enlarged outer portion, and attachment means for securing the board to a wall, said attachment means being characterized by (a) a plurality of hollow sleeves disposed internally of the panel, each sleeve being located within a small inner hole portion and extending coaxially thereto, (b) each sleeve having a flanged end located within the enlarged outer portion of the hole, said flange having a cross-section larger than the cross-section of the inner hole portion within which the sleeve is located, (c) each sleeve together with its flange being disposed completely within the panel intermediate the outer and inner surfaces thereof, (d) fasteners located within each sleeve and having wall penetrating ends protruding from the inner surface of the panel, each fastener having a head spaced inwardly from the outer surface of the panel and engaging with the flange, and (e) a reinforcing material clamped internally of each hole and having at least one segment extending outwardly of the hole and over the outer surface of the panel.

2. The insulation board of claim 1, wherein the reinforcing material is a flat, flexible material of cross-like configuration.

3. The insulation board of claim 2, wherein the cross-like reinforcing material has a plurality of members extending outwardly of the hole and over the outer surface of the panel.

4. The insulation board of claim 1, wherein the reinforcing material is a flat, flexible material of elongated tape-like configuration.

5. The reinforcing board of claim 4, wherein the tape-like reinforcing material extends between and is clamped within two spaced holes.

6. The insulation board of claim 5, further including (a) a second hollow sleeve located in each small inner hole portion of each composite hole, (b) each said second sleeve having a flange disposed externally of the panel adjacent its inner surface.

7. The insulation board of claim 1, further including plugs disposed internally of the holes adjacent the outer surface of the panel.

8. The insulation board of claim 1, wherein the panel comprises two contiguous panel components secured together to constitute a unitary structure.

9. The insulation board of claim 1, wherein the panel comprises a plurality of superimposed panel components.

10. Insulation board for attachment to the walls of buildings and the like comprising (a) a panel of insulation material having an inner surface to be disposed adjacent to a wall and an outer surface, (b) a plurality of spaced holes extending transversely through the panel, each hole having a relatively small inner hole portion terminating at the inner surface of the panel and a relatively large outer hole portion terminating at the outer surface of the panel, and (c) mechanical securing means for attaching the board to a wall, said securing means comprising (i) a plurality of hollow sleeves disposed internally of the panel, each sleeve having a body portion located in the small inner portion of one of the holes and a flange located in the large cuter portion of the hole, (ii) a fastener located within each sleeve, each fastener having a wall penetrating element and an enlarged head for engagement with the sleeve flange internally of the panel when the board is attached to a wall, and (iii) a reinforcing material secured internally of each hole and having at least one segment extending outwardly of the hole and over the outer surface of the panel.

11. The insulation board of claim 10, wherein each sleeve flange has a cross-sectional area larger than the cross-sectional area of the small inner hole portion in which the sleeve is located.

12. The insulation board of claim 10, further including (a) a second plurality of hollow sleeves disposed internally of the panel, (b) each sleeve of the second plurality of sleeves having a body portion located in the small inner portion of one of the holes and a flange located externally of the inner surface of the panel.

13. The insulation board of claim 10, further including plugs disposed internally of the relatively large outer hole portions of the holes.

14. Insulation board having an outer surface and an inner surface to be disposed against a wall, a plurality of transversely extending holes, each said hole having a relatively small inner portion and an enlarged outer portion, and attachment means for securing the board to a wall, said attachment means being characterized by (a) a plurality of hollow sleeves disposed internally of the board, each sleeve being located within the small inner portion of a hole and having an enlarged outer end located within the enlarged outer portion of the hole, (b) each sleeve together with its enlarged outer end being disposed intermediate the outer and inner surfaces of the board, (c) fasteners located internally of the sleeves and having wall penetrating ends protruding from the inner surface of the board, each fastener having a head spaced inwardly from the outer surface of the board and engaging the enlarged outer end of the sleeve in which the fastener is located, and (d) at least one reinforcing element secured internally of a hole by a sleeve and extending outwardly of the hole and over the outer surface of the board.

15. The insulation board of claim 14, further including plugs disposed internally of the holes intermediate the outer surface of the panel and the heads of the fasteners.

16. The insulation board of claim 14, wherein each enlarged outer sleeve end has a cross-section area larger than the cross-sectional area of the small inner hole portion in which the sleeve is located.

17. The insulation board of claim 14, wherein the board comprises a plurality of contiguous panels.

* * * * *